United States Patent [19]

Nakazato et al.

[11] 4,292,097

[45] Sep. 29, 1981

[54] HIGH TENSILE STRENGTH STEEL SHEETS HAVING HIGH PRESS-FORMABILITY AND A PROCESS FOR PRODUCING THE SAME

[75] Inventors: Yoshio Nakazato; Tomoo Tanaka; Koichi Hashiguchi; Naohiko Soeda, all of Chiba, Japan

[73] Assignee: Kawasaki Steel Corporation, Kobe, Japan

[21] Appl. No.: 68,018

[22] Filed: Aug. 20, 1979

[30] Foreign Application Priority Data

Aug. 22, 1978 [JP] Japan ..... 53-102054

[51] Int. Cl.[3] ..... C21D 8/04; C21D 7/04

[52] U.S. Cl. ..... 148/12 C; 148/12.4; 148/36

[58] Field of Search ..... 148/12 C, 12 D, 12 F, 148/12.3, 12.4, 134, 143, 144; 75/123 N

[56] References Cited

U.S. PATENT DOCUMENTS

| | | | |
|---|---|---|---|
| 3,806,376 | 4/1974 | Toda et al. | 148/12 C |
| 3,865,645 | 2/1975 | Takahashi et al. | 148/12.3 |
| 3,920,487 | 11/1975 | Gondo et al. | 148/12.3 |
| 3,951,696 | 4/1976 | Gondo et al. | 148/12 C |
| 4,040,873 | 8/1977 | Nakaoka et al. | 148/12 C |
| 4,062,700 | 12/1977 | Hayami et al. | 148/134 |
| 4,067,756 | 1/1978 | Koo et al. | 148/144 |
| 4,072,543 | 2/1978 | Coldren et al. | 148/12 F |
| 4,129,461 | 12/1978 | Rashid | 148/12.3 |
| 4,159,218 | 6/1979 | Chatfield et al. | 148/144 |
| 4,196,025 | 4/1980 | Davies | 148/12 F |

*Primary Examiner*—Peter K. Skiff

*Attorney, Agent, or Firm*—Balogh, Osann, Kramer, Dvorak, Genova & Traub

[57] ABSTRACT

High tensile strength steel sheets having high press formability and excellent shape-fixability in which an average roughness in surface Ha is 0.4–1.8 μm, PPI value is more than 80 at a cut off level of 0.5 μm, the proportional limit stress is less than 20 kg/mm$^2$ and the microstructure consists of ferrite grains dispersed with fine martensite islands, are produced by cold rolling a hot rolled steel sheet containing 0.005–0.15% of carbon, and manganese, if necessary boron, molybdenum, chromium, silicon, nickel and copper within a range of 0.27–3% of Mneq. shown by the following formula (1)

$$\text{Mneq.} = \text{Mn} + 124\text{B} + 3\text{Mo} + 3/2\text{Cr} + \tfrac{1}{3}\text{Si} + \tfrac{1}{3}\text{Ni} + \tfrac{1}{2}\text{Cu} \quad (1)$$

so as to obtain the cold rolled steel sheet having the above described surface property and then heating the cold rolled steel sheet to an intercritical temperature between $A_1$ and $A_3$, after which cooling the heated steel sheet at a particularly defined cooling rate.

4 Claims, 4 Drawing Figures

Figure 1A:
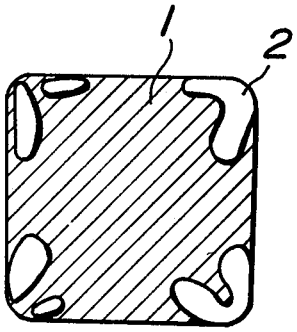

HIGH TENSILE STRENGTH STEEL SHEETS HAVING HIGH PRESS-FORMABILITY AND A PROCESS FOR PRODUCING THE SAME

The present invention relates to high tensile strength steel sheets having excellent press-formability and particularly excellent shape-fixability, and a method for producing therefor.

Recently, it has been intended to obtain high tensile strength steel sheets for automobile panels in order to decrease the body weight, but the high tensile strength steel sheets generally possess high yield strength and are liable to cause the spring back upon press forming and it is very difficult to give the given shape by press forming.

On the other hand, high tensile strength steels having dual phase structure which have been recently particularly interested, are composed of the microstructure in which the hard martensite is dispersed in the soft ferrite, so that the tensile strength is high but the yield strength is low and the age-hardenability is large after press forming, and therefore these steel sheets are considered to be the most favorable steel sheets for automotive use. However, the standard to be accepted as the quality of the high tensile strength steel sheets having such a dual phase structure is 0.2% proof stress and a yield ratio which is the ratio of said value to the tensile strength and it has been considered that such steel sheets have the satisfactory formability when 0.2% proof stress is low and the yield ratio is small.

On the other hand, the proper surface roughness and flatness are required for the steel sheets for press forming. In order to obtain such a surface property, the steel sheets have been heretofore subjected to temper rolling after having heat treatment. The temper rolling of a reduction of about 1.0% has been effective for the steel having the above described dual phase structure in order to lower the upper yield strength and such a temper rolling has been usually used. As the result, the conventional high tensile strength steel sheets of the dual phase structure are low in 0.2% proof stress and the yield ratio but the proportional limit stress is substantially equal to 0.2% proof stress.

When these sheets are applied to the outer sheet panel of automobiles having large curvature, the fitness to the punch surface is poor, so that it is necessary to provide large beads on the die face upon pressing and it becomes difficult to control the tensile stress to the curved surface having a complicated shape and an excessive stress is locally applied and the breakage of material may occur.

The inventors have aimed to provide high tensile strength steel sheets having excellent shape fixability in which the above described drawbacks in the steels having the conventional dual phase structure are obviated and a process for producing such steel sheets and made diligent studies. Then it has been found that in order to obtain the fitness of the steel sheets to the punch, it is necessary to make the proportional limit stress value lower other than the already known conditions and that for producing such steel sheets it is necessary to give the necessary surface property prior to obtaining the dual phase structure, and the present invention has been accomplished.

The present invention is summarized in the following.

(1) High tensile strength steel sheets having excellent shape-fixability in which a surface average roughness Ha is 0.4–1.8 μm, PPI value is more than 80 at a cut off level of 0.5 μm, the proportional limit stress is less than 20 kg/mm$^2$ and the microstructure consists of ferrite grains dispersed with fine martensite islands.

(2) A process for producing high tensile strength steel sheets having excellent shape-fixability, in which an average surface roughness Ha is 0.4–1.8 μm, PPI value is more than 80 at 0.5 μm cut off level and a proportional limit stress is less than 20 kg/mm$^2$ and the microstructure consists of ferrite grains dispersed with fine martensite islands, characterized in that hot rolled steel sheets containing 0.005–0.15% of carbon, and manganese, if necessary boron, molybdenum, chromium, silicon, nickel and copper within a range of 0.27–3% of Mneq. shown by the following formula (1)

$$\text{Mneq.} = \text{Mn} + 124\text{B} + 3\text{Mo} + 3/2\text{Cr} + \tfrac{1}{3}\text{Si} + \tfrac{1}{3}\text{Ni} + \tfrac{1}{2}\text{Cu} \quad (1)$$

are cold rolled to provide the desired surface property, and then the cold rolled steel sheets are heated to an intercritical temperature between $A_1$ and $A_3$, after which the cooling is carried out so that a cooling rate, CR°C./sec, satisfies the following formula (2) in the relation to the above described Mneq.

$$2.5 \geqq \log \text{CR} \geqq -1.11\text{Mneq.} + 2.8 \quad (2)$$

In the steel sheets according to the present invention, it is necessary that as the surface property Ha is 0.4–1.8 μm and PPI value is more than 80 at a cut off level of 0.5 μm. Such a surface property is defined in order to give the necessary tensile stress to the shape fixing surface by the friction force to the die face surface upon pressing and in view of highlight.

When the steel sheets are press formed, the fitness of the steel sheets to the punch surface is influenced by various conditions but when the surface property satisfies the above described conditions, the proportional limit stress should be less than 20 kg/mm$^2$, and is preferred to be less than 18 kg/mm$^2$.

Heretofore, concerning this point, only the stress at 0.2% permanent elongation, that is, 0.2% proof stress has been considered to be the indication. But the inventors have found that only such an indication is unsatisfactory and the requirements defined in the present invention should be satisfied.

Such property values not only have never been heretofore defined in relation to the fitness, but also are the level which has never been accomplished in the conventional high strength cold rolled steel sheets and are the greatest characteristics of the present invention.

Figure 1B:
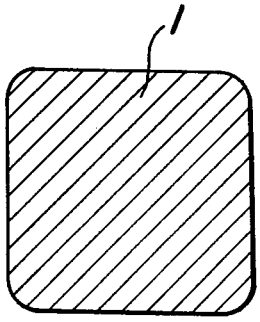

FIGS. 1, (a) and (b) show the influence of the proportional limit stress to the fitness by the shape of the fitted portion when a square cylindrical punch having a spherical bottom having a radius of 1,500 mm is used and (a) is the case of the conventional steel wherein the proportional limit stress is substantially equal to 0.2% proof stress and (b) is the case where the proportional limit stress is low as in the definition of the present invention.

In the case of (a), the fitness to the punch is poor and therefore the portions 2 where do not contact with the punch, remain at the four corners and it is impossible to form complicated shaped articles. While, the case of (b) shows substantially the complete fitness and if the above described surface property is satisfied, a sufficient tensile stress is applied to every portion upon pressing and the desired shape can be obtained. The proportional limit stress necessary for giving the sufficient fitness is 20 kg/mm$^2$, preferably less than 18 kg/mm$^2$ and when this requirement is satisfied, the fitness is very good. But it has been confirmed that when the proportional limit stress exceeds the limited value, even if 0.2% proof stress is relatively low, the fitness is poor.

Figure 2:
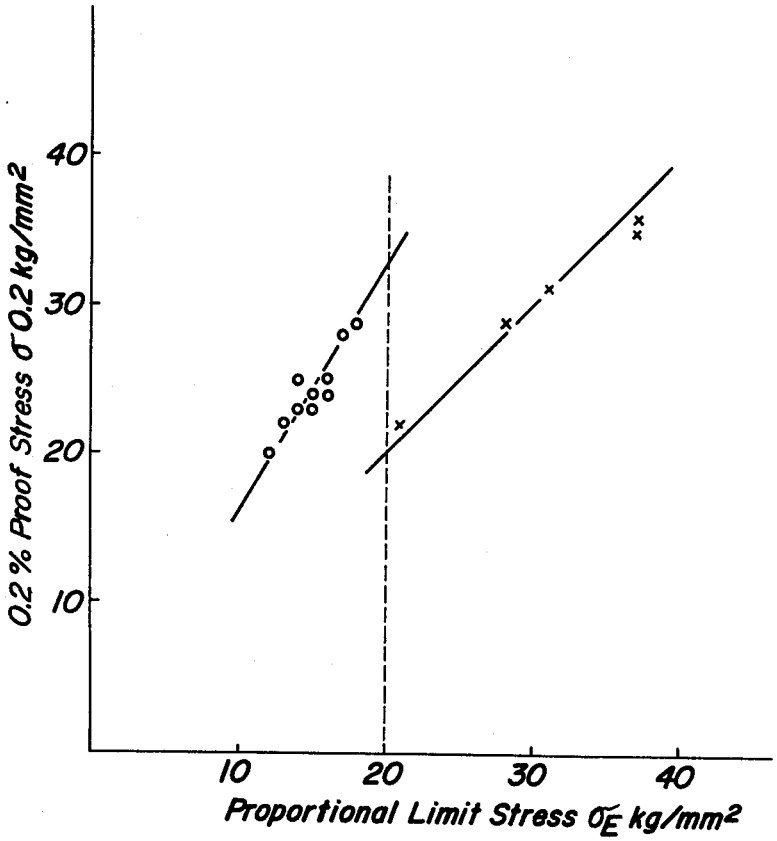

FIG. 2 shows the relation of the proportional limit stress ($\sigma_E$) and 0.2% proof stress ($\sigma_{0.2}$) of the steel of the present invention (mark o) and a conventional steel. The steel of the present invention is larger than the conventional steel in the ratio of $\sigma_{0.2}/\sigma_E$ and has the ratio of about 1.6, while said ratio of the conventional steel is about 1.0.

It is necessary for obtaining the satisfactory fitness that the steel sheets have the above described properties. In order to give these properties to the sheets, dual phase structure wherein fine martensite, the volume fraction of which is 3–10%, is dispersed in ferrite matrix, and no strain occurs due to temper rolling, is preferable.

An explanation will be made with respect to the process for producing the steel sheets of the present invention.

In the present invention, as mentioned hereinafter, such a processing that the strain is introduced in the steel is not applied after dual phase structure has been obtained. For the purpose, in the production of the steel sheets of the present invention, the heat treated steel sheets should have the sufficient flatness. According to the inventor's study, for giving such a flatness the cooling rate from the intercritical temperature between $A_1$ and $A_3$ should be less than 300° C./sec, preferably less than 250° C./sec. According to the result of the experiment, in order to obtain the dual phase structure steels in which the hard phase including martensite phase is dispersed in the ferrite phase, under such a cooling rate, Mneq. value defined by the following formula (1) must be more than 0.27%

$$\text{Mneq.} = \text{Mn} + 124\text{B} + 3\text{Mo} + 3/2\text{Cr} + \tfrac{1}{3}\text{Si} + \tfrac{1}{3}\text{Ni} + \tfrac{1}{2}\text{Cu} \quad (1)$$

If Mneq. is more than this value, after heated at the temperature just above the point $A_1$ (for example 770° C.) for about 30 seconds and cooled at a rate of 300° C./sec, the dual phase structure including martensite dispersed in ferrite matrix is obtained and the steel sheets suitable for the object of the present invention can be obtained.

In the present invention, the composition is defined so that the desired structure can be obtained by cooling from the temperature between $A_1$ and $A_3$, and as far as the above described relation formula is satisfied, the content of each component is not critical. But, Mneq. must be less than 3.0% in order to decrease the maximum hardness in spot welded part.

Other than the components described in the above formula, carbon is limited to 0.005–0.15%. The lower limit is the amount necessary for obtaining the stable $\gamma$ phase and the upper limit is the amount for limiting the maximum hardness upon spot welding. Therefore, the maximum value of carbon is advantageous to be 0.10%.

Other than the above described components, the remainder is substantially iron excluding impurities, and the steel may be Al killed steel containing 0.02–0.08% of aluminum depending upon the object of the steel of the present invention and it is advantageous to control the sulfur content as low as possible.

Hardening elements, such as phosphorus, vanadium, niobium and the like may be contained depending upon the necessary level of the tensile strength, as far as the object of the present invention is not hindered.

The steels satisfying the above described composition, after hot rolling, are cold rolled into the final gauge. In this case, the above described necessary surface property (Ha: 0.4–1.8 μm, PPI value: more than 80 at cut off level of 0.5 μm) should be given to the final product at the final rolling stage.

The surface roughness heretofore given upon final cold rolling has been the degree of satin finishing given for preventing the tight adhesion upon tight annealing since the temper rolling is to be carried out after annealing, and the surface roughness is smaller than dull texture in the temper rolling and attention has not been paid to PPI value and the flatness.

According to the present invention, all the surface properties usually given at the temper rolling are given at the final cold rolling.

The thus obtained cold rolled steel sheets having the desired surface property are heat treated in order to obtain the desired microstructure, that is the structure wherein even if a heat treatment is conducted, no stretcher strain is caused.

For the purpose, the heating temperature is within the temperature range between $A_1$ and $A_3$ but in order to obtain about 3–10% of martensite in the product, it is necessary to form the austenite phase corresponding to said amount. In practice, a temperature of 730°–830° C. is adopted.

Then, the steel sheets are cooled and the cooling rate (CR) is determined as follows in the relation to Mneq.

Figure 3:
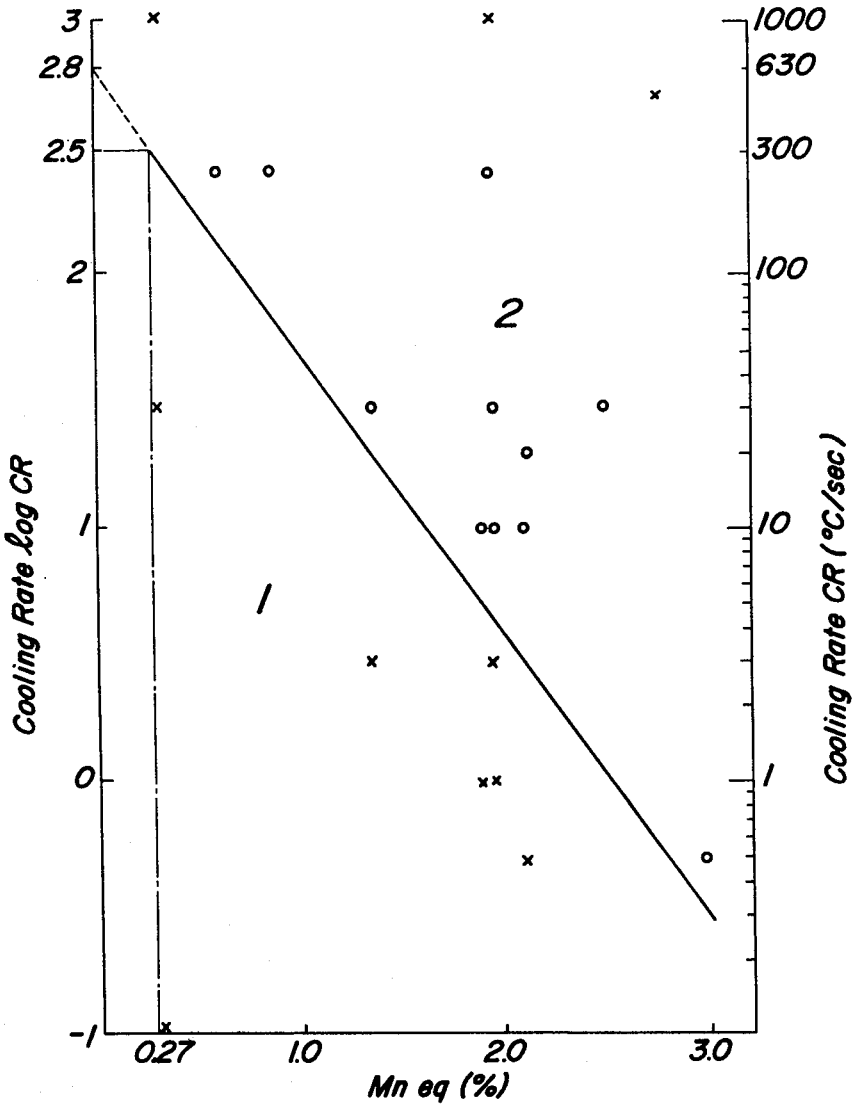

FIG. 3 shows the boundary condition where the microstructure obtained by heating at a temperature between $A_1$ and $A_3$ and then cooling the steel, becomes the above described desired structure, in the relation of Mneq. to the cooling rate (CR).

In FIG. 3, at zone 1 microstructure does not contain martensite and the stretcher strain occurs, and at zone 2 the microstructure consists of fine martensite dispersed in ferrite matrix and the stretcher strain does not occur. The products marked by o are those which include an appropriate amount of martensite and have $\sigma_E$ of less than 20 kg/mm$^2$ and fulfill the object of the present invention. When this is combined with the cooling rate for obtaining the above mentioned flatness, the following requirement is obtained.

$$300 \geqq \text{CR} \geqq 10 - 1.11\text{Mneq.} + 2.8$$

or $$2.5 \geqq \log \text{CR} \geqq -1.11\text{Mneq.} + 2.8$$

The steel sheets heat treated under these conditions are immediately coiled without conducting the step for introducing strain, such as temper rolling.

The present invention will be explained in more detail.

For better understanding of the invention, reference is taken to the accompanying drawings, wherein:

FIGS. 1, (a) and (b) show the influence of the proportional limit stress of the conventional steel and the steel of the present invention to the fitness respectively;

FIG. 2 shows the relation of the proportional limit stress of the steels of the present invention and the conventional steel to 0.2% proof stress; and FIG. 3 shows the boundary condition wherein the microstructure of steels heated at a temperature between $A_1$ and $A_3$ and then cooled, becomes the dual phase structure in the relation of Mneq. to the cooling rate CR (°C./sec).

The following examples are given for the purpose of illustration of this invention and are not intended as limitations thereof.

EXAMPLE 1

A steel consisting of 0.06% of C, 1.20% of Mn, 0.012% of P, 0.009% of S, 0.50% of Cr, 0.042% of Al and the remainder being substantially Fe was melted, continuously cast and hot rolled into a hot rolled coil having a thickness of 2.6 mm, and then the coiled steel sheet was cold rolled into a thickness of 0.7 mm and simultaneously passed through rolls satin (Ha: 1.0μ) finished with steel grid, which were set to the final stand, under a pressure of 0.9 T/mm$^2$ to obtain a flat cold rolled coil having surface roughness Ha of 1.0μ and PPI of 98 (cut off: 0.5μ). Then, said coil was kept at 800° C. for 30 seconds in the continuous annealing and cooled at a rate of 30° C./sec.

As the result, the obtained steel sheet has the mechanical properties of a proportional limit stress of 14 kg/mm$^2$, 0.2% proof stress of 23 kg/mm$^2$, a tensile strength of 53 kg/mm$^2$ and a total elongation of 34%, and has the excellent fitness and the highlight property necessary for the automobile outer sheet.

EXAMPLE 2

A steel consisting of 0.01% of C, 1.70% of Mn, 0.013% of P, 0.006% of S, 0.035% of Al and the remainder being Fe was melted, continuously casted and hot rolled into a sheet having a thickness of 2.6 mm and the hot rolled sheet was coiled. The coiled steel sheet was cold rolled into a thickness of 0.7 mm and simultaneously passed through rolls satin (Ha: 3.0μ) finished with steel grid, which were set to the final stand under a pressure of 1.1 T/mm$^2$ to obtain a flat cold rolled coil having a surface roughness Ha of 1.1μ and PPI of 105 (cut off: 0.5μ). This coil was kept at 850° C. for 30 seconds in the continuous annealing and then cooled at a rate of 30° C./sec.

The obtained steel sheet has a proportional limit stress of 12 kg/mm$^2$, 0.2% proof stress of 20 kg/mm$^2$, a tensile strength of 41 kg/mm$^2$ and a total elongation of 39% and has an excellent fitness and a good highlight property.

As mentioned above, the steel sheets according to the present invention are excellent in the shape fixing property and can be stably produced by the process of the present invention.

What is claimed is:

1. A process for producing high tensile strength steel sheets with the surface roughness being given at the cold rolling, having excellent shape-fixability and a proportional limit stress less than 20 kg/mm$^2$, in which the microstructure consists of ferrite grains dispersed with fine martensite islands, the volume fraction of martensite being in a range of 3–10%, which comprises cold rolling a hot rolled steel sheet containing 0.005–0.15% of carbon, and manganese, if necessary boron, molybdenum, chromium, silicon, nickel and copper within a range of 0.27–3% of Mneq. shown by the following formula (1)

$$\text{Mneq.} = \text{Mn} + 124\text{B} + 3\text{Mo} + 3/2\text{Cr} + \tfrac{1}{3}\text{Si} + \tfrac{1}{3}\text{Ni} + \tfrac{1}{2}\text{Cu} \quad (1)$$

so as to obtain the cold rolled steel sheet having such a surface property, that an average surface roughness Ha is 0.4–1.8 μm, PPI value is more than 80 at 0.5 μm cut off level and then heating the cold rolled steel sheet to intercritical temperature between $A_1$ and $A_3$, after which cooling the heated steel sheet so that a cooling rate, CR°C./sec, satisfies the following formula (2) in the relation to the above-described Mneq.

$$2.5 \geqq \log \text{CR} \geqq -1.11\text{Mneq.} + 2.8 \quad (2).$$

2. The process as claimed in claim 1, wherein said cooling rate is less than 300° C./sec.

3. The process as claimed in claim 2, wherein said cooling rate is less than 250° C./sec.

4. The process as claimed in claim 1, wherein said range of intercritical temperature is 730°–830° C.

* * * * *